US005330110A

United States Patent [19]

Williams

[11] Patent Number: 5,330,110

[45] Date of Patent: Jul. 19, 1994

[54] APPARATUS FOR GRINDING MATERIAL TO A FINENESS GRADE

[76] Inventor: Robert M. Williams, 16 La Hacienda, Ladue, Mo. 63124

[21] Appl. No.: 89,094

[22] Filed: Jul. 12, 1993

[51] Int. Cl.[5] ..... B02C 15/00

[52] U.S. Cl. ..... 241/53; 241/79.1; 241/80; 241/119; 241/121; 241/152.2; 241/275

[58] Field of Search ..... 241/53, 79.1, 80, 119, 241/124, 121, 152.2, 275

[56] References Cited

U.S. PATENT DOCUMENTS

| | | | |
|---|---|---|---|
| 1,517,900 | 12/1924 | Gay | 209/139.1 |
| 2,092,307 | 9/1937 | Gaffney | 241/53 |
| 2,099,505 | 11/1937 | Weaver | 209/139 |
| 2,304,264 | 12/1942 | Lykken | 241/275 X |
| 3,071,330 | 1/1963 | Jackering | 241/53 |
| 3,285,523 | 11/1966 | Duyckinck et al. | 241/531 |
| 3,951,347 | 4/1976 | Tiggesbaumker et al. | 241/119 X |
| 3,955,766 | 5/1976 | Chang | 241/56 |
| 4,451,005 | 5/1984 | Urayama | 241/40 |
| 4,541,574 | 9/1985 | Gygi | 241/119 X |
| 4,550,879 | 11/1985 | Tanaka et al. | 241/52 |
| 4,597,537 | 7/1986 | Misaka et al. | 241/119 X |
| 4,640,204 | 2/1987 | Williams | 110/347 |
| 4,673,134 | 6/1987 | Barthelmess | 241/57 |
| 4,682,738 | 7/1987 | Chang | 241/56 |
| 4,689,141 | 8/1987 | Folsberg | 209/144 |
| 4,721,258 | 1/1988 | Dougan et al. | 241/119 X |
| 4,830,290 | 5/1989 | Williams | 241/59 |
| 4,993,647 | 2/1991 | Williams | 241/52 |

FOREIGN PATENT DOCUMENTS

| | | | |
|---|---|---|---|
| 188191 | 1/1957 | Austria | 241/53 |
| 214922 | 12/1919 | Fed. Rep. of Germany | 241/53 |
| 3617746 | 12/1987 | Fed. Rep. of Germany | 241/119 |
| 3801229 | 7/1989 | Fed. Rep. of Germany | 241/119 |
| 408652 | 4/1910 | France | 241/124 |
| 239131 | 9/1986 | German Democratic Rep. | 241/53 |
| 202906 | 8/1923 | United Kingdom | 241/124 |
| 2038204 | 7/1980 | United Kingdom | 241/80 |

*Primary Examiner*—Mark Rosenbaum
*Assistant Examiner*—Frances Han
*Attorney, Agent, or Firm*—Polster, Lieder, Woodruff & Lucchesi

[57] ABSTRACT

A material reducing mill having a construction which operates to create a circulation of material in the mill to effect a thorough reduction of material added to the material undergoing reduction. The mill is further constructed with a rotary device which is associated with an external collection system, which device constantly samples the circulation in the mill so as to withdraw that portion which can be fed into the collection system. Furthermore, the external collection system is provided with sensors which are adapted to regulate the circulation of the material intended to be reduced to micron size portions.

9 Claims, 3 Drawing Sheets

APPARATUS FOR GRINDING MATERIAL TO A FINENESS GRADE

BACKGROUND OF THE INVENTION

This invention is directed to apparatus for grinding material to a desired fineness grade and to associated means for circulating material to effect a desired reduction of the material prior to evacuating the material after achieving desired fineness reduction.

It is known from U.S. Pat. No. 4,830,290 of May 16, 1989 to provide a roller mill with means in the grinding chamber for imparting an the upward lift to the material for improving the fluidization of material to maintain a substantially constant particle size for delivery to an outlet.

It is also known from U.S. Pat. No. 4,993,647 of Feb. 19, 1991 to operate material separator for obtaining refined material subject to a first reduction which moves the material into a separate where the large and/or heavier particles are returned by gravity to fall back into the first reduction for further reduction while the finer ground material is subjected to a second separation by a rotary device which alloys passage of particles of a smaller size while larger particles are refused passage and fall back for further reduction.

Some mills, as in U.S. Pat. No. 4,673,134 of Jun. 16, 1987, have a high throughput rate and effect a fine division as between fines and coarse particles in the outlet. In such mills the coarse particles can be removed by a pneumatic separator in that a rejecting grid is provided to include inclined blades which will retain very coarse particles.

It is also known from the system in U.S. Pat. No. 1,517,900 of Dec. 2, 1924 that small particles of solid material to be separated and graded or classified are fed into a separating chamber and air is caused to circulate through an endless path and through the separating chamber. In such a system the fine particles or "fines" are separated from the heavier or coarse particles or "tailings" within the separating chamber. Thus the "fines" are carried by the circulating air up through and out of the separating chamber while the "tailings" settle within the chamber and pass from the bottom thereof through a suitable discharge opening without further reduction.

To a lesser extent it is known from U.S. Pat. No. 2,099,505 of Nov. 16, 1937 to provide an efficient inexpensive apparatus which will clean seeds by means of air blasts and to provide means for equalizing the air blasts so the air is equally distributed throughout the apparatus. It is also known from the before listed U.S. Pat. No. 4,673,134 of Jun. 16, 1987 that mills in general are desired to have a high throughput rate and to effect a fine division with the amount of coarse particles in the outlet minimized, and in a more pertinent apparatus refined material is subject to a reduction in which the larger and heavier particles are separated out and returned by gravity to fall back into the first grind reduction for further reduction with the finer ground material being subject to a second separation by a rotary device.

BRIEF DESCRIPTION OF THE INVENTION

The invention has as an important object the provision in apparatus for grinding material to a selective fineness and to a system for maintaining an internal circulation of material in an air stream so that material reduction can continue to develop a fineness that can be evacuated from the internal circulation of material.

A further object of the invention is to provide a casing structure for a material grinding mill that receives material output from the mill and initiates particle size selection in a revolving circulation system with means to continuously sample the system for the evacuation of the micron size portions of the circulating material.

Another object of the invention is to operate a material reducing mill in an enclosure having an outlet for acceptable micron size particles, and to maintain an internal circulation of material through the mill so that new material can be supplied to enter into the internal circulation so as to maintain a production at the final outlet of desired volume of micron sized particles.

It is also an object of the invention, where micron fineness is to be produced, to maintain a material classifier with an outlet connection having a seal to intercept passage in bypass of the outlet flow of particles having an undesirable size, and to augment the seal with a positive air backup.

Other objects of the invention will be set forth in detail in the following description.

BRIEF DESCRIPTION OF THE DRAWINGS

Material processing apparatus for carrying out the objects of the invention set forth above is illustrated in the following views, wherein.

DETAIL DESCRIPTION OF THE EMBODIMENTS

Figure 1:
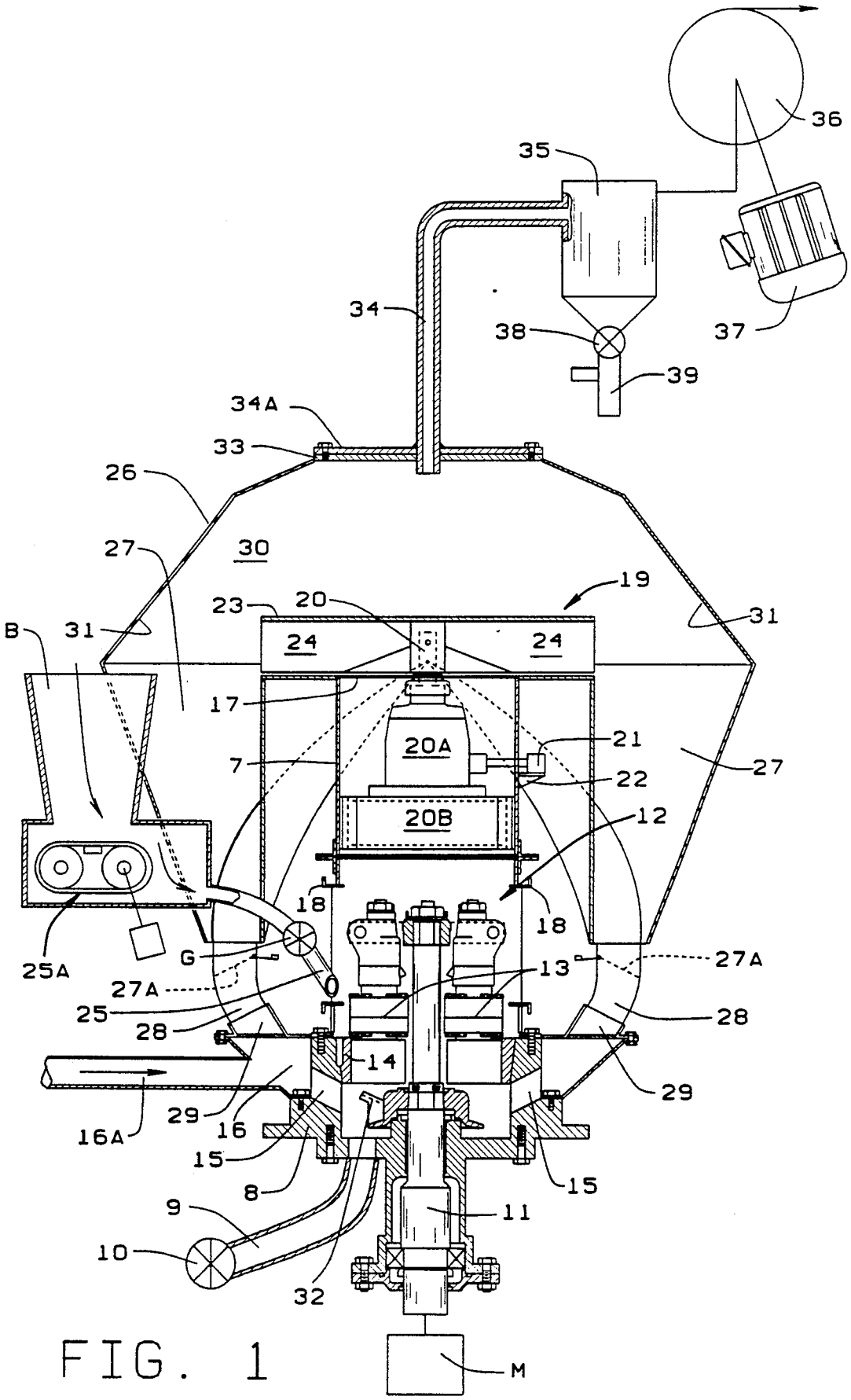
FIG. 1 is a vertical sectional view of a material reducing mill for practicing the general purpose of the invention.

In the embodiment seen in FIG. 1, the assembly includes a vertical frame 7 having a base structure in the form of casting 8 which provides a scrap throwout 9 with a rotary gate 10. The casting 8 also supports a drive shaft 11 extending upwardly to operate a roller grinding assembly 12 having grinding rolls 13 cooperating with a bull ring 14. The casting 8 provides material and air inlet openings in the form of a series of flow ports 15 opening from a bustle space 16. An air supply conduit 16A is connected into the bustle. In addition the mill roller assembly 12 in the base structure 8 is enclosed by a suitable vertical frame structure 7 that is connected to the base structure 8 so as to form a passage which extends upwards to an outlet end 17, having access windows 18 for which closure panels are not shown. A fan-type rotor 19 is operably mounted on the drive shaft 20 of a gear box 20A on a support 20B and connected to an electric motor 21 supported in a suitable space adjacent the frame structure 7 on a mounting 22. The fan has a closed disc 23 which carries a plurality of radially directed blades 24 which have radially open outer ends. Material to be reduced is admitted to the roller assembly 12 in frame structure 7 by a feed pipe 25 having a rotary gate G to control the flow of material into the roller grinding space. The feed pipe 25 directs the incoming material from a typical weigh belt feeder 25A through the rotary gate G into the mill 12, such gate acts as an air lock.

The assembly includes a casing 26 having diametrally spaced passages 27 which are formed with outlet tubes 28 connected into fittings 29 in the bustle 16. The upper ends of the passages 27 open into an enlarged chambered space 30 which is formed with cone-shaped wall surfaces 31. The cone-shaped wall surfaces 31 are located to be in alignment with the open ends of the fan rotor blades 24 so that material thrown out horizontally by the fan rotor impinges upon the walls 31 and the heavier particles are deflected downwardly and gravitate into the passages 27. Such particles pass through the tubes 28 and flow through ports 15 to be elevated by suitable plow elements 32 and the fluidizing gas generated by fan 24 into the orbits of the mill rollers 13. It is understood that if there is no outlet or a closed outlet for the chambered space 30 other than tubes 28, the fan 19 and the mill assembly 12 will constantly generate a circulation or flow vertically up the frame 7, horizontally against the wall 31 and vertically downwardly in passages 27 so that the circulating material will be repeatedly reduced to a fine powdery form in the rollers 13. Each tube 28 is provided with a counterweighted flapper plate 27A which is normally in an open position, but closes the tube 28, 27 against reverse upward flow toward the chamber 30.

However, as seen in FIG. 1, the chambered space 30 is provided with an outlet flange 33 to which is connected a conduit 34 by its adapter flange 34A; the conduit 34 leading to a baghouse separator 35 which operates to place the space 30 under a negative pressure. During operating conditions, the roller grinder assembly 12 initiates the reduction of incoming material, the motor driven fan 19 develops upon horizontal flow of the ground material an internal circulation of material that has been sufficiently reduced to be influenced to exit at conduit 34 and be separated in the baghouse separator 35 by operation of a fan 36 operated by motor 37 with a rotary gate 38 to control outlet 39. The fan 36 creates a negative pressure in the mill bustle to draw in outside air in conduit 16A.

The material reducing mill seen in FIG. 1 introduces a material reducing system in which the output of material from the roller assembly 12 moves vertically in the passage structure 17 under the influence of the fan 19 where centrifugal disposition thereof occurs off the ends of the blades 24. The heavy and insufficiently reduced particles impinge on wall 31 and fall by gravity in the passages or tubes 27 so as not to be in counterflow opposition to the rising flow of material in structure 7. This absence of counterflow between the rising flow from the roller assembly 12 and the gravity return flow in tubes 27 reduces the power consumption of the roller assembly 12 and the motor 21 for the fan 19, and there is a significant improvement in the efficiency of the system.

Figure 2:
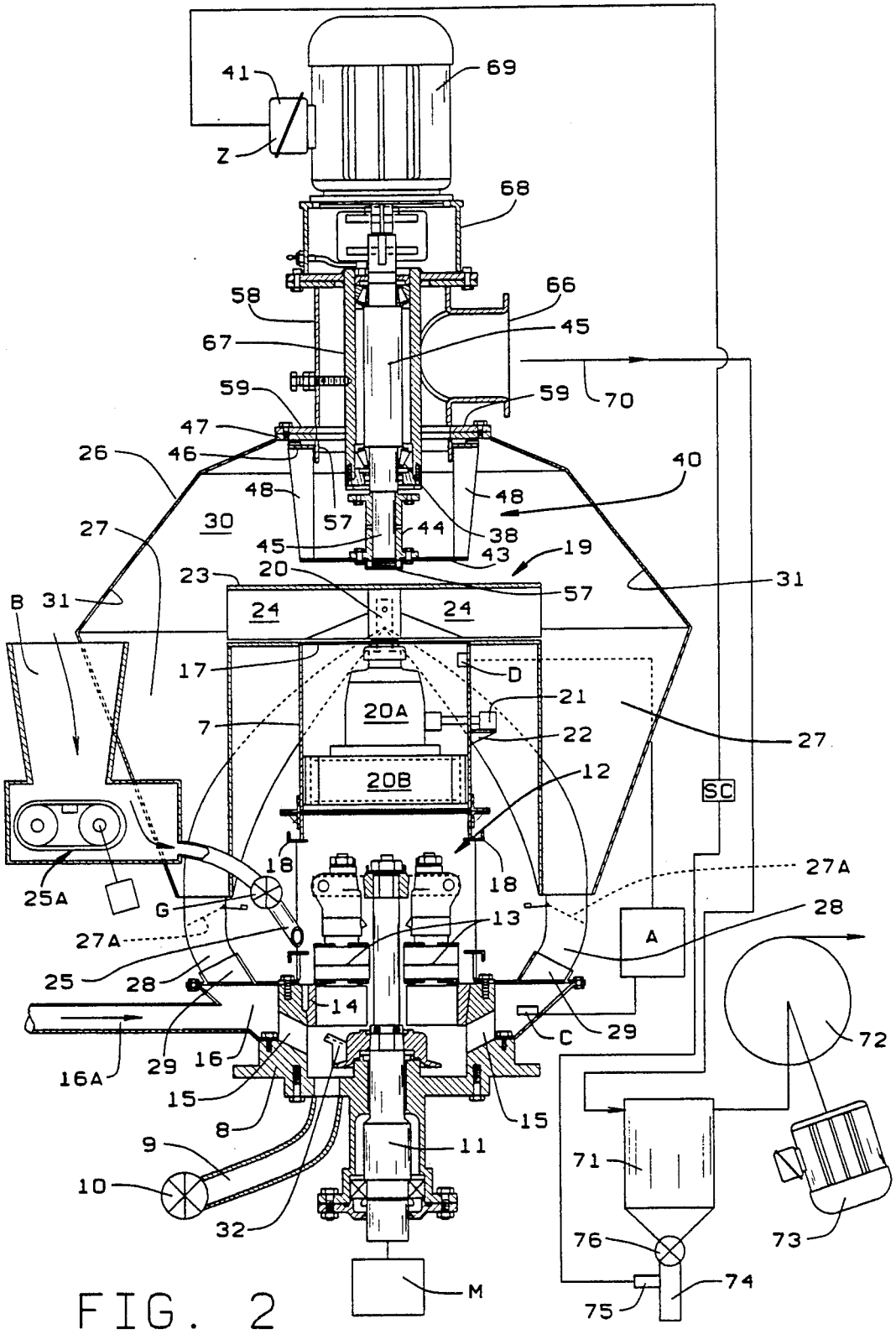
FIG. 2 is a vertical sectional view of a material reducing mill for practicing a further purpose of the invention.
Figure 3:
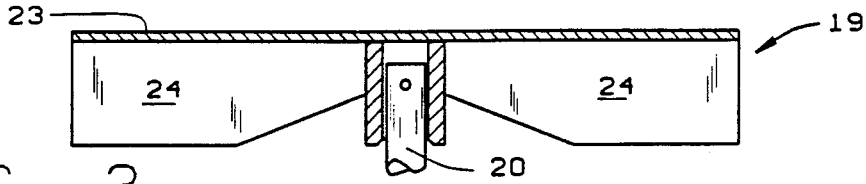
FIG. 3 is a sectional view of an air moving fan wheel employed in the mill seen in FIG. 2.

A modified form of apparatus over that seen in FIG. 1 is disclosed in FIG. 2 where parts similar to those in FIG. 1 are shown again but combined with a spinner separator assembly 40 mounted on the flange 33 of the housing 26. The addition of a spinner separator assembly 40 is embodied in FIG. 2, as follows.

THE ISOKINETIC SEPARATOR

Figure 4:
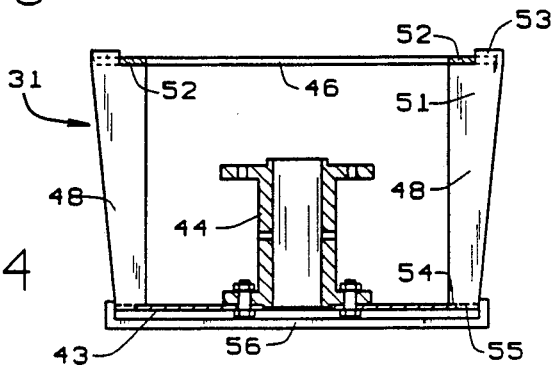
FIG. 4 is a sectional view of spinner assembly employed in the mill of FIG. 2.
Figure 4A:
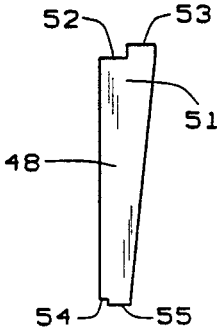
FIG. 4A is a view of a typical blade element in the spinner assembly.
Figure 5:
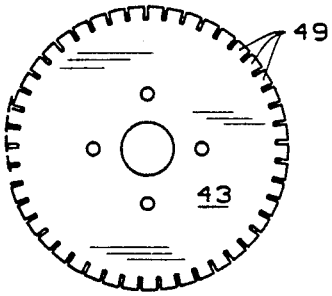
FIG. 5 is a plan view of the lower plate of the spinner assembly seen in FIG. 3.
Figure 6:
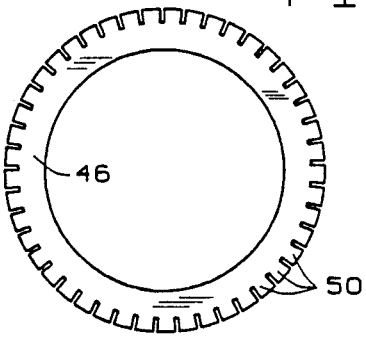
FIG. 6 is a plan view of the upper plate of the spinner assembly seen in FIG. 2.

The views of FIG. 2 disclose that a spinner separator assembly 40 is positioned to project into chamber 30 and comprises a lower plate 43 attached to a sleeve 44 fitted a drive shaft 45. The assembly 40 has a mounting ring 46 that is centrally open to match the open ring 47 so it permits commmunication upwardly within the sleeve 58. The upper ring 46 is retained in spaced relation with plate 43 by a series of blades 48. As seen in FIGS. 4, 5, and 6, the plate 43 is formed with a series of radially directed slots 49 which are in the circumferential rim of the plate 43. In FIG. 6 it is seen that the ring 46 is formed with a series of radially directed slots 50. The slots 49 and 50 are similar in number and are intended to be in axial alignment so that the blades 48 will mate with aligned slots 49 and 50. It is understood that the blades 48 are individually mounted in the slots 49 and 50. For example and as seen in FIG. 4A, the upper wider ends 51 of blades 48 have a notch 52 and an elongated tang 53. The notch 52 seats against the surface of the ring 46 in slot 50 and the tangs 53 project through the slot 50 for a suitable distance and form fan elements above the ring 46. The bottom end of the blades 48 has notches 54 which abutt on the upper face of the plate 43 while the tang 55 fits into the slot 49. Thus the notches 52 and 55 fix the spacing of the plate 43 and ring 46. Each blade can be easily positioned by first inserting the tang 55 into a slot 49 followed by pivoting or swinging the upper end into a matching slot 50. Thereafter when all fan blades 48 have been assembled a suitable retaining ring 56 can be removably attached in any convenient way to the bottom of the plate 43 to hold the blades 48 in the slots 49 and 50.

Figure 7:
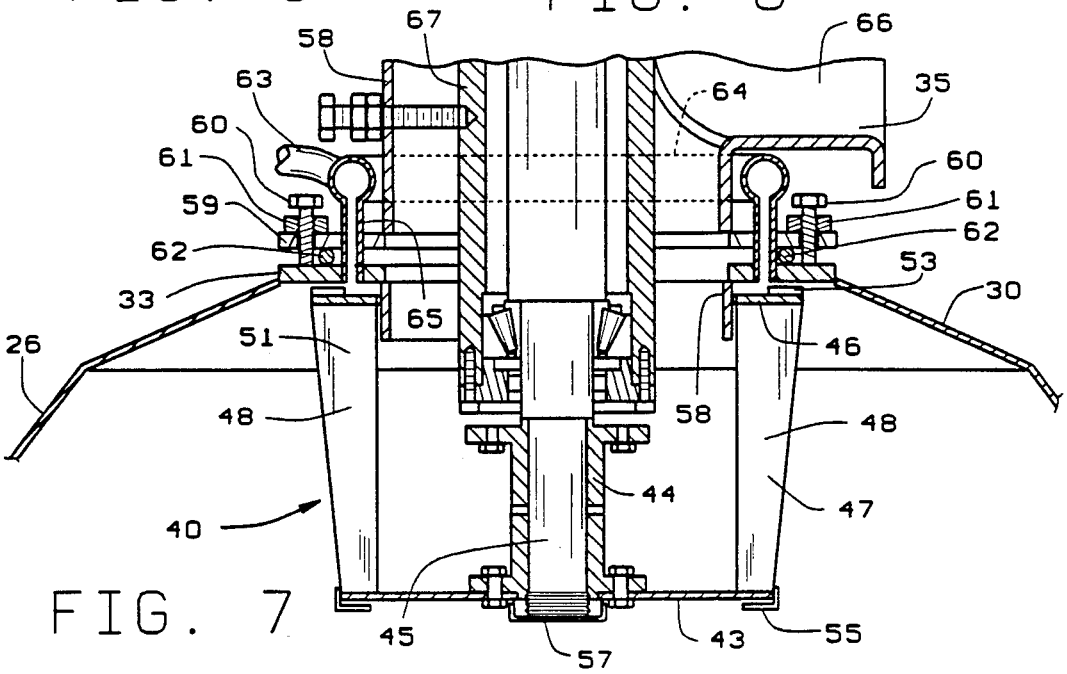
FIG. 7 is a sectional view of the spinner assembly showing a seal structure adjacent the outlet of the assembly in FIG. 2.

Turning now to FIG. 7, the spinner separator 40 after it has been mounted by sleeve 44 on the drive shaft 45 and secured by a cap nut or the like 57, and has reached a position where a support ring 59 assumes a snug fit around an annular sleeve 58 fixed to the support ring 59 supported on the cover flange 33. The ring 59 is spaced from the ring 33, and the tangs 53 on the respective blades 48 rotate in that space and provide, with suitable clearance, an effective rotary fan seal so that the micron grade fines and other particles will not be able to penetrate the seal and bypass the blade elements 48. In order to adjust the spacing between flange 33 and ring 59, there are disposed a plurality of (usually 4) jacking screws 60 which abut on the flange 33 and are fixed in adjusted position in ring 59 by lock nuts 61. The resulting space between the flange 33 and the ring 59 is sealed by an 0-ring 62 positioned inside the positions of the jack screws 60, and an optional supply of pressure air is brought in from a source conduit 63 to a ring distributor 64 having branch outlets 65 opening to the space to be pressurized against escape of the fine particles passing up and around the bottom end of sleeve 58 on its flow to the outlet 66. The drive for the separator assembly 40 is through the shaft 45 extending upwardly through a bearing sleeve 67 so that the upper end of the shaft 45 is connected to a suitable coupling device in the box 68 which is mounted on the sleeve 58 and a motor 69 is placed on that box 68.

Having now described the characteristics of the material processing mill, it can be appreciated that in operation of the motors M and 21, and with material being supplied at feed pipe 25, the material is ground by the rolls 13 and is moved upwardly in the casing 7 to be centrifugally thrown into the space 30. Assuming no outlet from space 30, the coarse or heavier material will be deflected by the cone-shaped wall 31 to return by passages 26 and tubes 28 to the roller mill bustle 16 where further reduction takes place. An especially important feature of the processing assembly is that in returning the insufficiently reduced material to the mill that circulation does not flow in counter current relation to the material lifted by the fluid bed in the mill casing 7. Thus, there is no extra energy required to effect the material circulating down in passages 27 and tubes 28 and upwardly in casing 7. The finer material tends to remain in the space 30.

Another important characteristic of the invention is the operation of the spinner separator 40 which constantly samples the condition of reduction of the material in the space 30 and allows the escape of the micron size particles to pass out through the space between elements 48 so it can flow through the outlet flange 33 and support ring 59 on its way to outlet 66. The outlet 66 is connected by a suitable conduit 70 for flow into a baghouse 71 which is under a negative pressure generated by a fan 72 operated by motor 73. The fan 72 draws the air out and leaves substantially small micron size material in the baghouse 71. The micron size material collected by the baghouse 71 can be periodically or continually withdrawn through the outlet 74 controlled by a rotary gate 76.

The material processing mill is provided with a control system mounted in box A, and that system is provided with pressure sensing elements D and C respectively in the passage 7 and in the material recycling bustle 16 to sense the differential pressure between those areas which is in the range of 6 to 8 inches in a manometer. While the control system has not been shown in detail, it is intended to respond to the sensors D and C which sample the condition of fluidization of the material in space 7 relative to the condition of the flow of material being recycled back to the mill 12 so that there is a way of setting the speed of the motor M to obtain a smooth processing of material being supplied at the outlet from the space 7. The motor 21 for the fan 19 is set at a desired speed to distribute the material into the space 30. The sensor 75 however indicates the fineness grade of the micron size particles and can be adjusted to speed up the isokinetic separator to yield a desired grade of fineness or to slow it down if the fineness is too fine. The control box SC adjusts the speed of the motor 69 as dictated by the sensor 75.

The foregoing specification has disclosed preferred embodiments of the invention, and it is understood that the scope of the inventions is not to be unnecessarily limited as changes may be made which are substantial equivalents of the herein discussed parts, elements and cooperating components.

What is claimed is:

1. Apparatus for grinding material to a selective finenes grade, in which the apparatus comprises:

a) a vertical frame forming a passage having a base formed with material receiving inlet means and a material outlet spaced from said base;

b) grinding means adjacent said base for grinding material received at said inlet means;

c) a material circulating fan positioned adjacent said material outlet for moving said material out of said outlet;

d) a casing surrounding said vertical frame passage and spaced therefrom, said casing providing a chamber adjacent said fan, said chamber having a selective fine material outlet and a bypass passage for other than selective fine material connected into said base material receiving inlet means for further grinding;

e) motor driving said grinding means;

f) fineness grade material collecting means connected to said chamber fine material outlet, said collecting means effecting withdrawal of selective fine material from said chamber having the selective fineness grade; and g) means initially supplying material to said grinding means to mingle with said other than selective fine material.

2. The apparatus set forth in claim 1 wherein said bypass passage for other than selective fine material is independent of said vertical frame forming passage.

3. The apparatus set forth in claim 1 wherein said selective fine material outlet includes a spinner separator assembly projecting into said casing, and motor means connected thereto for rotating said spinner separator independently of said motor driving said grinding means.

4. The apparatus set forth in claim 1 wherein said casing presents a wall to said material circulating fan in position to direct a portion of material from said circulating fan out of said chamber and into said bypass passage for further grinding.

5. The apparatus set forth in claim 1 wherein said casing for directing portions of ground material is shaped to deflect such portions back to said grinding means.

6. Apparatus for grinding material to a selective fineness grade in which the apparatus comprises:

a) a mill having grinding rolls and a base formed with openings for directing material into the orbit of said grinding rolls;

b) a vertical frame structure on said base and extending beyond said grinding rolls to form a passage for conducting ground material out of the mill, said passage having an outlet;

c) a circulating fan positioned adjacent said passage outlet;

d) a casing having a wall surrounding said circulating fan to provide a chamber for receiving ground material from said circulating fan;

e) passage forming structure connecting said chamber with said mill base openings;

f) motor means connected to said fan to circulate ground material into said chamber and return ground material from said chamber through said passage forming structure for reduction by said grinding rolls; and g) means positioned in said chamber spaced from said circulating fan and being rendered operative to evacuate material portions from said chamber that are ground to a selective fineness grade.

7. The apparatus set forth in claim 6 wherein said means positioned in said chamber is an open ended conduit extending to the exterior of said chamber, and means connected to said conduit is in operative position to collect selective fineness grade material.

8. The apparatus set forth in claim 6 wherein said means positioned in said chamber is a material spinner separator operative for passing material having a selective fineness size grade and refusing material of other size grade.

9. Apparatus for grinding material received from an outside source to be ground to a selective fineness grade, the apparatus comprising:

a) a mill for grinding material having an inlet to receive material from an outside source;

b) a vertically directed passage into which said mill delivers ground material, said passage providing an outlet end for the ground material;

c) rotary fan means adjacent said vertical passage outlet end for impelling ground material horizontally outwardly;

d) casing means enclosing said ground material delivery passage and said fan means and forming an enlarged chamber to collect ground material received from said rotary fan means, said casing means having an outlet for material ground to a selective fineness grade;

e) other passage means connecting said enlarged chamber with said mill for directing gravity impelled material from said casing back to said mill for further reduction;

f) selectively operable motor means connected to said mill and to said rotary fan for maintaining material circulating flow between said casing means and said mill means to continue material reduction; and g) means connected to said casing means outlet to evacuate material of a selective fineness grade from the circulating flow of material maintained between said rotary fan and said mill means.

* * * * *